United States Patent [19]

Gonzales, Jr.

[11] Patent Number: 4,743,021

[45] Date of Patent: May 10, 1988

[54] SPORTS RACKET HAVING ARCUATELY CURVED HANDLE

[76] Inventor: Frank Gonzales, Jr., 33657 Arrowhead, Westland, Mich. 48185

[21] Appl. No.: 875,971

[22] Filed: Jun. 19, 1986

[51] Int. Cl.[4] ..... A63B 49/08

[52] U.S. Cl. ..... 273/75

[58] Field of Search ..... 273/75, 735, 76, 73 R, 273/67 R

[56] References Cited

U.S. PATENT DOCUMENTS

| | | | |
|---|---|---|---|
| 1,291,464 | 1/1919 | Folliard | 273/76 |
| 2,616,698 | 11/1952 | Singer . | |
| 3,203,697 | 8/1965 | Berzatzy . | |
| 4,131,278 | 12/1978 | Goldenberg . | |
| 4,351,528 | 9/1982 | Duplin . | |
| 4,351,529 | 9/1982 | Schultze et al. | 273/75 |
| 4,402,508 | 9/1983 | Pflueger | 273/75 |
| 4,470,599 | 9/1984 | Usher, Jr. . | |
| 4,478,416 | 10/1984 | Gibello . | |

FOREIGN PATENT DOCUMENTS 1900214 8/1970 Fed. Rep. of Germany ..... 273/75

OTHER PUBLICATIONS

"The Gripper"; Mechanics Illustrated Magazine; 6-1984; p. 104.

"The Cheater"; Popular Science Magazine; 1-1982; p. 84.

*Primary Examiner*—Matthew L. Schneider

*Attorney, Agent, or Firm*—Gifford, Groh, VanOphem, Sheridan, Sprinkle and Dolgorukov

[57] ABSTRACT

A handle for a sports racket in which the sports racket has a flat hitting portion, an elongated neck extending outwardly from the hitting portion and a handle attached to the free end of the neck. The handle includes an elongated body which is dimensioned to be gripped by a human hand. The body is continuously arcuately curved along its side which improves the feel and comfort of the handle when gripped.

3 Claims, 1 Drawing Sheet

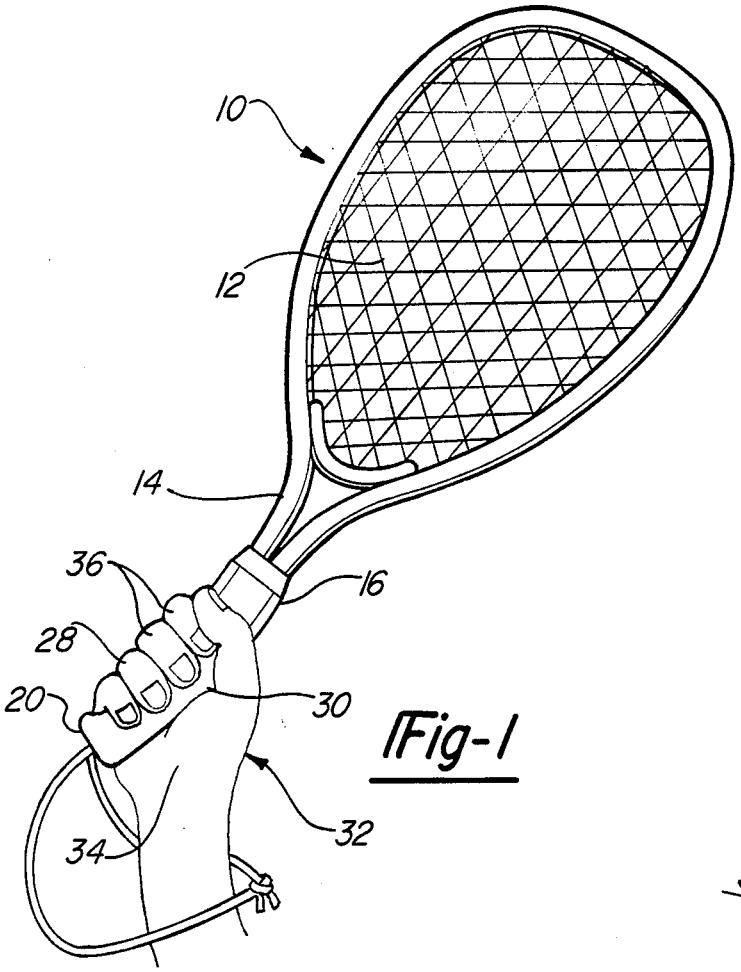
Fig-1
Fig-2
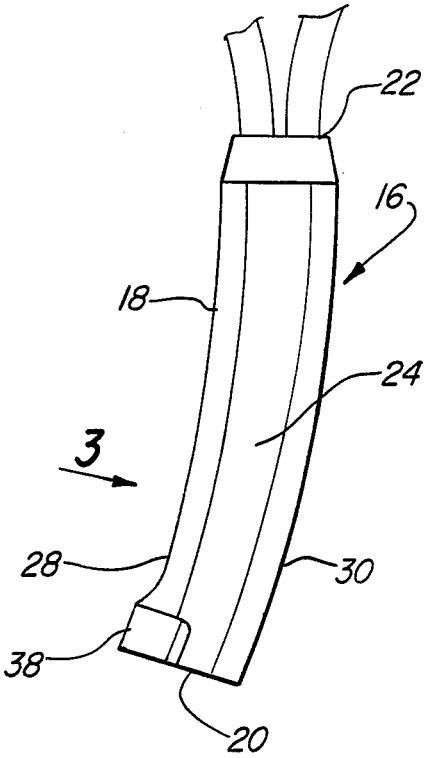
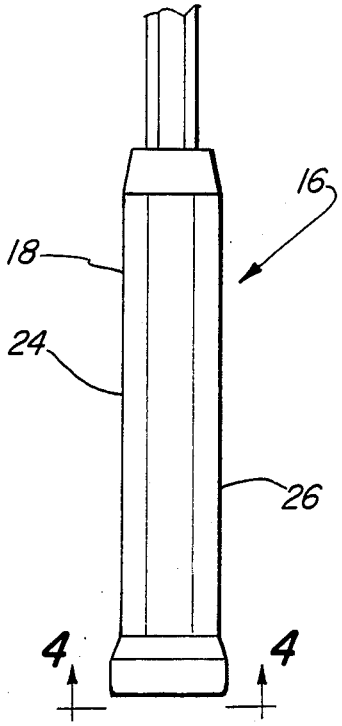
Fig-3
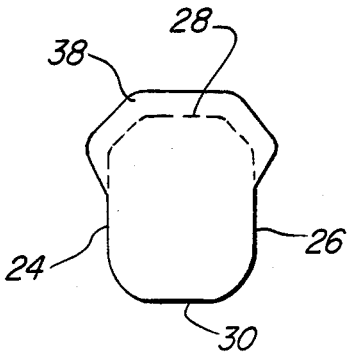
Fig-4

SPORTS RACKET HAVING ARCUATELY CURVED HANDLE

BACKGROUND OF THE INVENTION

I. Field of the Invention

The present invention relates to a handle for a sports racket.

II. Description of the Prior Art

Rackets and paddles, hereinafter collectively referred to as rackets, for use in tennis, badminton, paddleball, squash, racquetball and other sports include a flat hitting portion, an elongated neck which extends outwardly from the flat hitting portion and a handle which is secured to or formed at the free end of the neck. The size, feel and comfort of the handle when gripped is important during the play of the game since it not only allows better power and control of the ball when struck but also affects the overall enjoyment of the game.

The handles for the previously known conventional rackets typically include an octagonally shaped grip which is covered by leather, rubber, plastic or other material. Typically, the handle for the racket is straight so that the sides of the handle are planar, spaced apart and parallel to each other and, similarly, the front and back of the handle are planar, spaced apart and parallel to each other.

One disadvantage of these previously known handles, however, is that the palm does not conform well to the shape of the straight, octagonal handle when the handle is gripped during play of the game. As such, the handle cannot be firmly gripped by the hand and, as such, has a tendency to twist in the hand as a ball is struck. This twisting motion not only is uncomfortable to the player but also results in wild and uncontrolled shots.

SUMMARY OF THE PRESENT INVENTION

The present invention provides a handle for a sports racket which overcomes all the above-mentioned disadvantages of the previously known handles.

In brief, the handle of the present invention comprises an elongated body having a pair of sides which are spaced apart and parallel to each other and a front and back which are spaced apart and parallel with respect to each other. The front and back of the handle, furthermore, are generally planar in shape while, conversely, the sides of the handle are continuously arcuately curved along their length. Thus, when the handle is gripped by the hand, the convexly curved side of the handle abuts against the palm of the player hand while the player's fingers extend around the concavely curved side of the handle. In doing so, the handle firmly nests in the hand of the sports player.

In addition, in the preferred form of the invention, a lip protrudes outwardly from the free end of the handle around the concavely curved side and terminates at a midpoint at both the front and back of the handle. The other side of the handle, i.e. the side opposite the lip, abuts against the palm of the hand. This feature of Applicant's invention further minimizes slippage of the handle during play and increases both the feel and comfort of the grip during the play of the game.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a plan view illustrating a preferred embodiment of the present invention;

FIG. 2 is a plan view, similar to FIG. 1, but with parts removed and enlarged for clarity;

FIG. 3 is a fragmentary plan view taken substantially along arrow 3 in FIG. 2; and FIG. 4 is an end view taken along line 4—4 in FIG. 3 and enlarged for clarity.

DETAILED DESCRIPTION OF A PREFERRED EMBODIMENT OF THE PRESENT INVENTION

With reference first to FIG. 1, a preferred embodiment of the sports racket 10 of the present invention is thereshown and comprises a generally planar ball hitting portion 12. While the portion 12 illustrated in FIG. 1 is a racket, it may alternatively comprise a paddle or the like without deviation from the spirit or scope of the invention.

An elongated neck 14 protrudes outwardly from a lower end of the ball hitting portion 12 of the racket 10. A handle 16 is secured to the free end, or formed around the free end, of the neck 14.

With reference now to FIGS. 2 and 3, the handle 16 is thereshown in greater detail and comprises an elongated body 18 having a free end 20, an upper end 22 and a substantially uniform cross sectional shape along its length. The handle body 18 includes a front 24, rear 26 (FIG. 3) and two opposed sides 28 and 30.

As best shown in FIG. 3, the front 24 and back 26 of the handle body 18 are generally planar, parallel and spaced apart from each other. Conversely, as best shown in FIG. 2, the sides 28 and 30 are spaced apart and generally parallel to each other but, unlike the front 24 and back 26, the sides 28 and 30 are continuously arcuately curved along their length. Consequently, the side 30 is convexly curved while the side 28 is concavely curved.

With reference again to FIG. 1, with the handle 16 positioned within a player's hand 32, the convexly curved side 30 faces the player's palm 34 while the player's fingers 36 wrap around the concavely curved side 28 of the handle 16. In doing so, the handle 16 firmly, but comfortably, nests within the player's hand 32 as shown in FIG. 1. Simultaneously, the free end 20 of the handle 16 protrudes outwardly from the bottom of the hand 32 while the upper end 22 protrudes outwardly from the upper end of the player's hand 32.

With reference now particularly to FIGS. 2 and 4, a lip 38 protrudes outwardly from the concavely curved side 28 of the handle 16 adjacent its free end 20. This outwardly protruding lip 38 extends entirely around the concavely curved side 28 and terminates at a midpoint of the front 24 and back 26 as best shown in FIG. 4. Consequently, the convexly curved side 30 is free of the lip 38 at its lower end 20.

Since the lip 38 extends only around substantially one half of the lower end 20 of the handle 16, only the outside of the player's little finger, as shown in FIG. 1, abuts against the lip 38. Conversely, the free end of the handle opposite from the lip 38 nests against the palm 34 of the player's hand 32.

From the foregoing, it can be seen that the sports racket of the present invention provides a racket which is simple and inexpensive in construction but advantageously provides a firm and comfortable grip.

Although the racket of the present invention is particularly advantageous in the sport of racquetball, it can also be used with other types of racket and paddle sports, such as tennis, paddleball, squash and the like.

Having described my invention, however, many modifications thereto will become apparent to those skilled in the art to which it pertains without deviation from the spirit of the invention as defined by the scope of the appended claims.

I claim:

1. A sports racket having a flat hitting portion in a predetermined plane, an elongated neck extending outwardly from the hitting portion, a handle, said handle being attached to a free end of the neck and comprising an elongated body dimensioned to be gripped by a human hand, said body being continuously arcuately curved along substantially its entire length so that said body has a concavely curved side, a convexly curved side opposite from the concavely curved side and two spaced apart and parallel planar sides extending in between said concavely curved and said convexly curved sides, wherein said body is arranged so that each planar side lies in a plane which is substantially parallel with said plane of said flat hitting portion, an outwardly protruding lip at a free end of said handle, wherein said outwardly protruding lip, when viewed from the free end of said handle and looking along the length of the handle, extends entirely along said concavely curved side of said handle and said lip having its ends terminating respectively at intermediate points of said planar sides of said handle and also at positions closely adjacent said concavely curved side so that the free end of said handle on said convex side rests within the palm of the hand and so that said lip extends generally transversely with respect to said plane of said flat hitting portion wherein said lip extends less than halfway around an outer periphery of said handle.

2. The invention as defined in claim 1 wherein said body has a substantially uniform cross sectional shape along substantially its entire length.

3. The invention as defined in claim 2 wherein said handle is polygonal in cross sectional shape.

* * * * *